US009437940B1

(12) United States Patent
Rao et al.

(10) Patent No.: US 9,437,940 B1
(45) Date of Patent: Sep. 6, 2016

(54) TERMINAL BLOCK CONNECTOR

(71) Applicant: Jiangmen Krealux Electrical Appliances Co., Ltd., Guangdong (CN)
(72) Inventors: Xiaopo Rao, Guangdong (CN); Boqing Yin, Guangdong (CN)

( * ) Notice: Subject to any disclaimer, the term of this patent is extended or adjusted under 35 U.S.C. 154(b) by 0 days.
(21) Appl. No.: 14/940,158
(22) Filed: Nov. 13, 2015
(30) Foreign Application Priority Data

Apr. 11, 2015 (CN) ..... 2015 2 0215045 U

(51) Int. Cl.
*H01R 9/24* (2006.01)
(52) U.S. Cl.
CPC ..... *H01R 9/24* (2013.01)
(58) Field of Classification Search
CPC . H01R 4/4836; H01R 4/4845; H01R 4/4818
USPC ..... 439/436–441
See application file for complete search history.

(56) References Cited

U.S. PATENT DOCUMENTS 4,759,726 A * 7/1988 Naylor ..... H01R 4/5008 439/441
6,004,168 A * 12/1999 Fuchs ..... H01R 4/4845 439/630
6,341,989 B1 * 1/2002 Jaag ..... H01R 4/4827 439/725
6,689,955 B2 * 2/2004 Doutaz ..... H01R 4/4836 174/135
6,783,385 B2 * 8/2004 Rudy ..... H01R 4/4836 439/438
6,832,938 B2 * 12/2004 Lenker ..... H01R 4/4836 439/441
7,004,781 B2 * 2/2006 Walter ..... H01R 4/4836 439/268
7,059,920 B2 * 6/2006 Billow ..... H01R 4/4863 439/441
7,104,833 B2 * 9/2006 Oesterhaus ..... H01R 4/4836 439/441
7,150,646 B2 * 12/2006 Trumper ..... H01R 4/4818 439/441
7,238,043 B2 * 7/2007 Reibke ..... H01R 4/4827 439/441
7,762,834 B2 * 7/2010 Schrader ..... H01R 4/4836 439/441
8,062,077 B2 * 11/2011 Hayashi ..... H01R 4/4863 439/725
8,113,858 B1 * 2/2012 Chiang ..... H01R 4/4845 439/188
8,129,641 B2 * 3/2012 Majewski ..... H01R 4/4845 200/335
8,210,865 B2 * 7/2012 Hayashi ..... H01R 4/4836 439/409
8,262,422 B1 * 9/2012 Chiang ..... H01R 4/4836 439/441
8,292,677 B2 * 10/2012 Gassauer ..... H01R 13/15 439/729
8,388,387 B2 * 3/2013 Koellmann ..... H01R 4/4845 439/729
8,444,443 B2 * 5/2013 Schafmeister ..... H01R 4/4836 439/441
8,466,367 B2 * 6/2013 Reibke ..... H01R 4/4827 174/135
8,475,191 B2 * 7/2013 Schafmeister ..... H01R 4/4836 439/266
8,480,424 B2 * 7/2013 Koellmann ..... H01R 4/4836 439/358
8,491,327 B2 * 7/2013 Hartmann ..... H01R 31/085 439/441
8,500,498 B2 * 8/2013 Abundis ..... H01R 4/4836 439/828
RE44,490 E * 9/2013 Kirstein ..... H01R 4/4818 439/439
8,550,838 B2 * 10/2013 Osagle ..... H01R 4/4818 439/441
8,550,853 B2 * 10/2013 Fukushi ..... H01R 4/4836 439/441

(Continued)

*Primary Examiner* — Ross Gushi
(74) *Attorney, Agent, or Firm* — Prakash Nama; Global IP Services, PLLC

(57) ABSTRACT

A terminal block connector, having a front shell, a rear shell, a metal contact assembly, wire insertion openings, and pullable caps. The metal contact assembly is formed by front flexible metal strips and rear metal strips. The front flexible metal strips are tilted upwardly. Top portions of the rear metal strips have protruding strips. The tilted portions of the front flexible metal strips are positioned below the protruding strips and are in contact therewith. Bulges are provided on the top portion of the front shell each having two troughs on its two sides. One end of a pullable cap is a pulling grip, another end of which contains two symmetrical press strips. The symmetrical press strips are inserted into corresponding troughs. A press tip is formed at a bottom part of each press strip. Recesses corresponding to the press tips are provided on the front flexible metal strips.

5 Claims, 12 Drawing Sheets

(56) References Cited

U.S. PATENT DOCUMENTS 8,771,004 B2 * 7/2014 Fehling ..... H01R 4/4818 439/441
8,794,994 B2 * 8/2014 Kollmann ..... H01R 4/4836 439/441
8,851,920 B2 * 10/2014 Wu ..... H01R 4/4827 439/441
8,944,843 B2 * 2/2015 Keswani ..... H01R 4/4836 439/441
8,979,573 B1 * 3/2015 Barber ..... H01R 4/4836 439/441
9,124,034 B2 * 9/2015 Kollmann ..... H01R 4/4836
9,240,650 B2 * 1/2016 Wu ..... H01R 4/48
9,276,331 B2 * 3/2016 Stadler ..... H01R 4/4836
2003/0008569 A1 * 1/2003 Matsumoto ..... H01R 4/4827 439/835
2003/0066673 A1 * 4/2003 Doutaz ..... H01R 4/4836 174/652
2008/0108254 A1 * 5/2008 Eppe ..... H01R 4/4836 439/729
2009/0124139 A1 * 5/2009 Gerberding ..... H01R 9/2483 439/861
2010/0081316 A1 * 4/2010 Eppe ..... H01H 1/5844 439/441
2011/0223795 A1 * 9/2011 Schafmeister ..... H01R 4/4836 439/370
2011/0318972 A1 * 12/2011 Koellmann ..... H01R 4/4845 439/729
2012/0208394 A1 * 8/2012 Tseng ..... H01R 4/4818 439/438
2012/0238156 A1 * 9/2012 Hayashi ..... H01R 4/4836 439/820
2013/0157520 A1 * 6/2013 Koellmann ..... H01R 4/4836 439/834
2014/0370740 A1 * 12/2014 Kollmann ..... H01R 4/4836 439/438
2015/0162671 A1 * 6/2015 Hoppmann ..... H01R 4/4854 439/370
2015/0194745 A1 * 7/2015 Moser ..... H01R 4/4836 439/55
2015/0349437 A1 * 12/2015 Kollmann ..... H01R 4/4836 439/729
2015/0357727 A1 * 12/2015 Gassauer ..... H01R 4/4836 439/751
2015/0357728 A1 * 12/2015 Chen ..... H01R 4/48 439/725
2015/0372401 A1 * 12/2015 Stolze ..... H01R 4/4836 439/816
2015/0372402 A1 * 12/2015 Kollmann ..... H01R 4/4818 439/816
2015/0380837 A1 * 12/2015 Kollmann ..... H01R 4/4836 439/721
2015/0380838 A1 * 12/2015 Kollmann ..... H01R 4/4836 439/625
2016/0134054 A1 * 5/2016 Wu ..... H01R 4/4836 439/660

* cited by examiner

TERMINAL BLOCK CONNECTOR

BACKGROUND OF THE INVENTION

The present invention relates to the technical field of configuring a terminal block, and more specifically relates to a terminal block connector allowing wire connection by insertion and achieving wire connection and wire disconnection by pulling up the pullable caps.

A terminal block is a connector part used in electronic devices and electrical appliances for wire and power connection. It is an important wire connector for electrical connection and connection between one terminal block and another terminal block. Terminal blocks now available in the market have various different structures. However, they cannot achieve instant wire connection. In general, they require disassembly so that wires can be connected thereon by using for example, screw bolts and rivets. Accordingly, it is very complicated and effort draining to mount the wires and achieve connection, thereby increasing labour input but complicating the process and reducing the efficiency of wire connection. Moreover, it is very inconvenient since the terminal block has to be disassembled again and those fixation parts such as screw bolts have to be loosened to separate the wires from the contact pieces of the terminal block during disconnection of the wires from the terminal block. In particular, wire connection of those existing electronic devices or electrical appliances requires coordination between two terminal blocks for connection of hard wires and soft wires or wires of different wire strands, and there will be great trouble when the two terminal blocks cannot achieve instant connection. When a mega project requires wire connection in-situ, time and manpower input will be enormous in order to complete the complicated wire connection procedures. It is therefore not beneficial with respect to reducing the cost and labour input.

Although connector parts such as terminal blocks enabling instant wire connection have been developed, these terminal blocks are generally disadvantageous with respect to their complicated structures. Therefore, they are not easy to manufacture and involve a higher manufacturing cost. Also, the resulting wire connection is not good enough because the wires are not connected steadily and thus susceptible to accidental disconnection. Furthermore, they do not support quick connection and do not have a long service life. In particular, none of the prior arts has disclosed a configuration of terminal block suitable for wire connection of flexible wire and hard wire for quick mutual connection between two terminal blocks, or a configuration of terminal block enabling quick connection with an electronical device through one terminal block.

BRIEF SUMMARY OF THE INVENTION

In view of the aforesaid disadvantages now present in the prior arts, a terminal block connector is provided. The terminal block connector uses pullable caps which create downward pressing force when they are being pulled and turned upwardly; the downward pressing force of the pullable caps press the press tips of the press strips of the pullable caps downwardly. When the pullable caps are pulled upwardly, the press tips press downwardly against the recesses on top portions of the front flexible metal strips so that the free ends of the upwardly tilted top portions of the front flexible metal strips and their corresponding protruding strips provided at the top portions of the rear metal strips will not be in contact anymore and spaces therebetween will be created and the spaces will increase gradually as the press tips continue to press downwardly against the recesses; after that, wires can be smoothly inserted through the wire insertion openings and reach the spaces between the free ends of the upwardly tilted top portions of the front flexible metal strips and their corresponding protruding strips basically without encountering any resistant force. When the pullable caps are pressed downwardly, the press tips return to their original positions so that they no longer press tightly against the recesses on the top portions of the front flexible metal strips. Accordingly, the front flexible metal strips return to their original positions due to their resilience and fix the wires between the free ends of the upwardly tilted top portions of the front flexible metal strips and the corresponding protruding strips, thereby achieving firm and steady wire connection. The pullable caps have to be pulled up during both wire connection and wire disconnection. Wire connection is firm and steady and it is not required to disassemble the terminal block for wire connection throughout the wire connection procedures, thereby achieving instant wire connection which is achieved easily, conveniently and efficiently by simple procedures.

The present invention is attained as follows: A terminal block connector, comprising an insulated shell formed by a front shell and a rear shell; the insulated shell has a cavity inside formed by the front shell and the rear shell; a metal contact assembly is provided in the cavity of the insulated shell; a front end of the front shell is provided with wire insertion openings corresponding to the metal contact assembly; pullable caps are also provided at a top portion of the insulated shell; the metal contact assembly is an integral structure formed by front flexible metal strips corresponding to the wire insertion openings and rear metal strips corresponding to the rear shell; each of the front flexible metal strips has a C-shape whereas a top portion of the C-shaped front flexible metal strip is tilted upwardly; each of the rear metal strips has a reverse Z-shape; bottom portions of the rear metal strips are fixedly connected to bottom portions of the front flexible metal strips; top portions of the rear metal strips have protrusions of protruding strips; a free end of the upwardly tilted top portion of each of the front flexible metal strips is positioned below each of the protruding strips respectively and tightly contacts with a bottom portion of each of the protruding strips respectively; a top portion of the front shell is provided with bulges; a trough is provided at each of the two sides of each of the bulges; one end of each of the pullable caps is provided with a pulling grip, while another end of each of the pullable caps is provided with two symmetrical press strips which are branched from two sides of the pulling grip; the pulling grip is mounted at a top part of a front portion of the front shell and extends out of the front portion of the front shell; a front end of the pulling grip is provided with anti-slippery grooves; the two symmetrical press strips are inserted into corresponding troughs; a bottom portion of each of the press strips is provided with a press tip which protrudes to form an acute angle; each of two sides of the top portion of each of the front flexible metal strips is provided with a recess corresponding to a corresponding press tip; each recess has anti-slippery grooves in a terrace-shape provided on a surface thereof; when the pulling grip of each pullable cap is pulled upwardly, corresponding press tips will move downwardly and press tightly against corresponding recesses on a corresponding front flexible metal strip; frictional force is created between the anti-slippery grooves on corresponding surfaces of the corresponding recesses and the corresponding press tips so that the corresponding press tips press tightly against the corresponding recesses and will not displace, hence, the free end of the upwardly tilted top portion of the corresponding front flexible metal strip and a corresponding protruding strip will not be in contact anymore and a space therebetween will increase; a wire is inserted into the space between the free end of the upwardly tilted top portion of the corresponding front flexible metal strip and the corresponding protruding strip through a corresponding wire insertion opening; when the pullable cap is pressed downwardly to return to an original position, the corresponding press tips will no longer press tightly against the corresponding front flexible metal strip, and the corresponding front flexible metal strip will then reset to an original position thereof due to resilience to fix the wire tightly between the free end of the upwardly tilted top portion of the corresponding front flexible metal strip and the corresponding protruding strip, thereby achieving wire connection. During installation, the entire metal contact assembly is disposed inside the front shell; since the front shell has a relatively large cavity, such cavity can fix the metal contact assembly in position; after that, fix the front shell with the rear shell; finally, insert the press strips of each of the pullable caps respectively into two sides of a corresponding bulge formed on the front shell so that the corresponding press tips contact the corresponding recesses on the top portion of the corresponding front flexible metal strips. An entire terminal block connector is then installed.

Furthermore, an inner bottom part of the cavity formed by the front shell and the rear shell is provided with a limiting trough to limit a bottom portion of the metal contact assembly so that the metal contact assembly will not displace; second limiting troughs are provided inside the rear shell for insertion and limiting of the top portions of the rear metal strips; the rear shell is also provided with accommodation spaces each being employed for accommodating a part of the wire that has passed through the space between the free end of the upwardly tilted top portion of the corresponding front flexible metal strip and the corresponding protruding strip.

Furthermore, a front testing opening communicating with the cavity is provided at the front shell for testing whether the metal contact assembly is being electrically connected; a rear testing opening communicating with the cavity is provided at the rear shell for testing whether the metal contact assembly is being electrically connected.

Furthermore, hooks are provided at free ends of the top portions of the bulges and also at a bottom portion of the front shell; locking openings corresponding to the hooks are provided at both a top portion and a bottom portion of the rear shell; the hooks lock at the locking openings in order to fixedly connect the front shell and the rear shell.

Furthermore, a quantity of the wire insertion openings is three; correspondingly, the metal contact assembly is provided with three front flexible metal strips and three rear metal strips forming the metal contact assembly as an integral structure; correspondingly, a quantity of the pullable caps is also three, a quantity of the bulges is also three, and a quantity of the accommodation spaces is also three.

In summary, the terminal block connector of the present invention uses pullable caps which create downward pressing force when they are being pulled and turned upwardly; the downward pressing force of the pullable caps press the press tips of the press strips of the pullable caps downwardly. When the pullable caps are pulled upwardly, the press tips press downwardly against the recesses on the top portions of the front flexible metal strips so that the free ends of the upwardly tilted top portions of the front flexible metal strips and their corresponding protruding strips provided at the top portions of the rear metal strips will not be in contact anymore and spaces therebetween will be created and the spaces will increase gradually as the press tips continue to press downwardly against the recesses; after that, wires can be smoothly inserted through the wire insertion openings and reach the spaces between the free ends of the upwardly tilted top portions of the front flexible metal strips and their corresponding protruding strips basically without encountering any resistant force. When the pullable caps are pressed downwardly, the press tips return to their original positions so that they no longer press tightly against the recesses on the top portions of the front flexible metal strips. Accordingly, the front flexible metal strips return to their original positions due to their resilience and fix the wires between the free ends of the upwardly tilted top portions of the front flexible metal strips and the corresponding protruding strips, thereby achieving firm and steady wire connection. The pullable caps have to be pulled up during both wire connection and wire disconnection. Wire connection is firm and steady and it is not required to disassemble the terminal block for wire connection throughout the wire connection procedures, thereby achieving instant wire connection which is achieved easily, conveniently and efficiently by simple procedures.

DETAILED DESCRIPTION OF THE INVENTION

Embodiment 1

Figure 1:
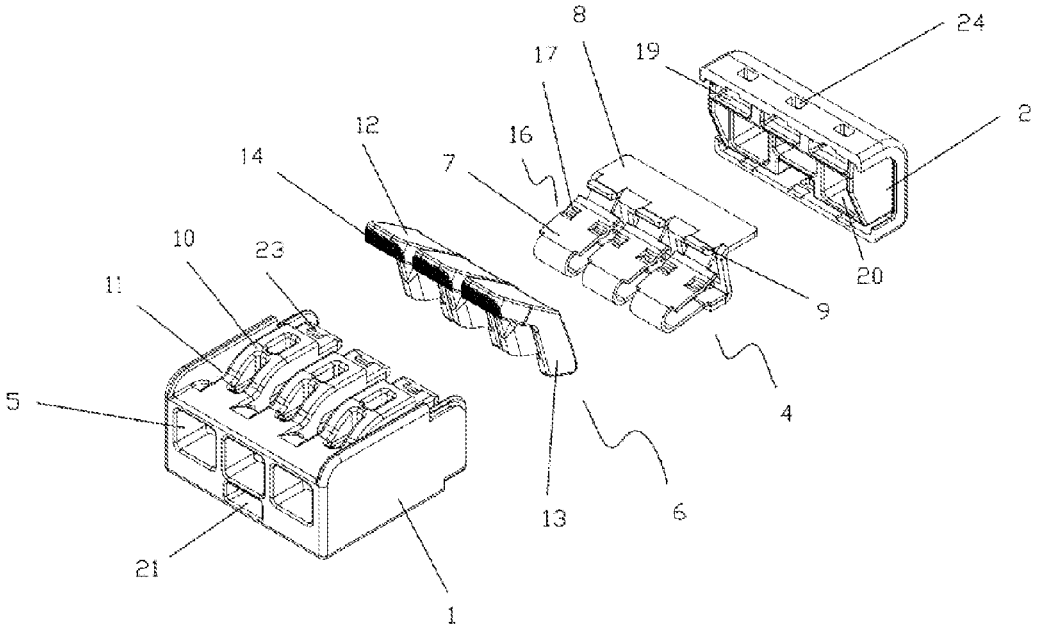
FIG. 1 is an exploded view showing the structure of the terminal block connector.
Figure 2:
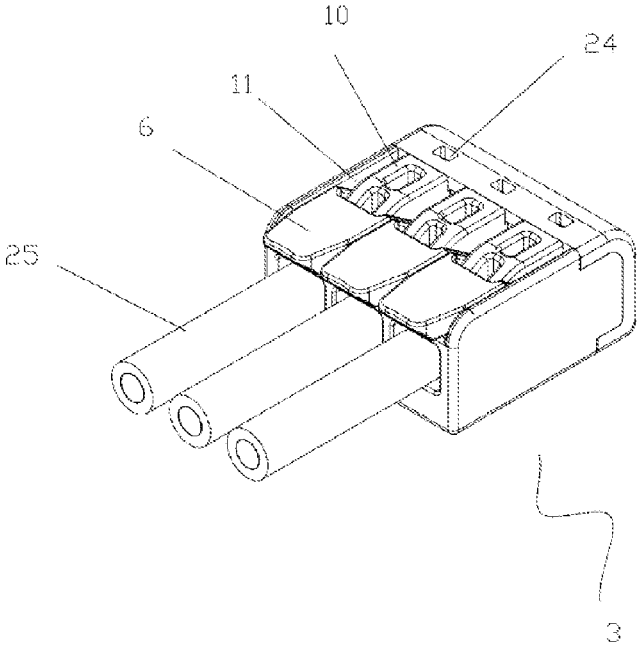
FIG. 2 is a schematic structural view showing connection between the terminal block connector and the wires.
Figure 3:
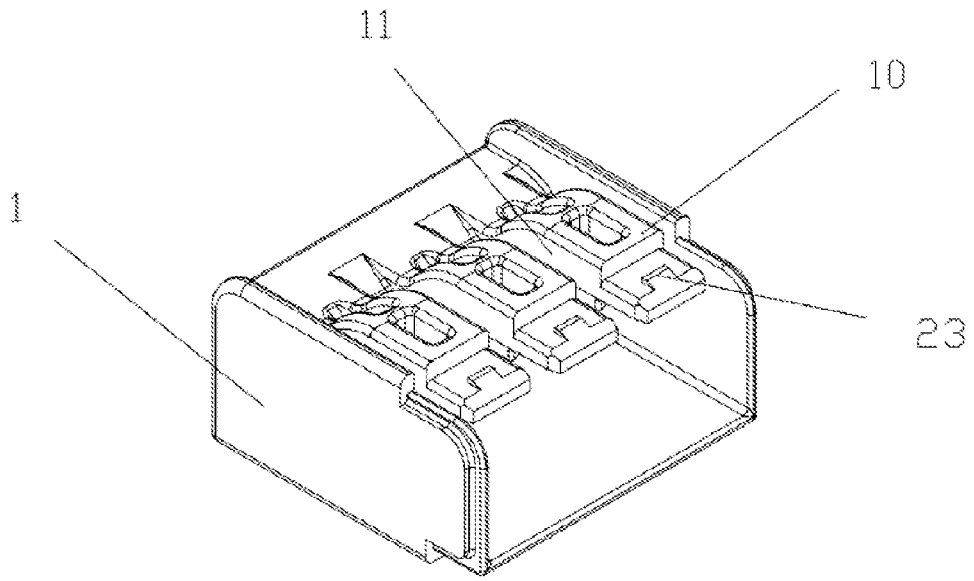
FIG. 3 is a schematic structural view of the front shell.
Figure 4:
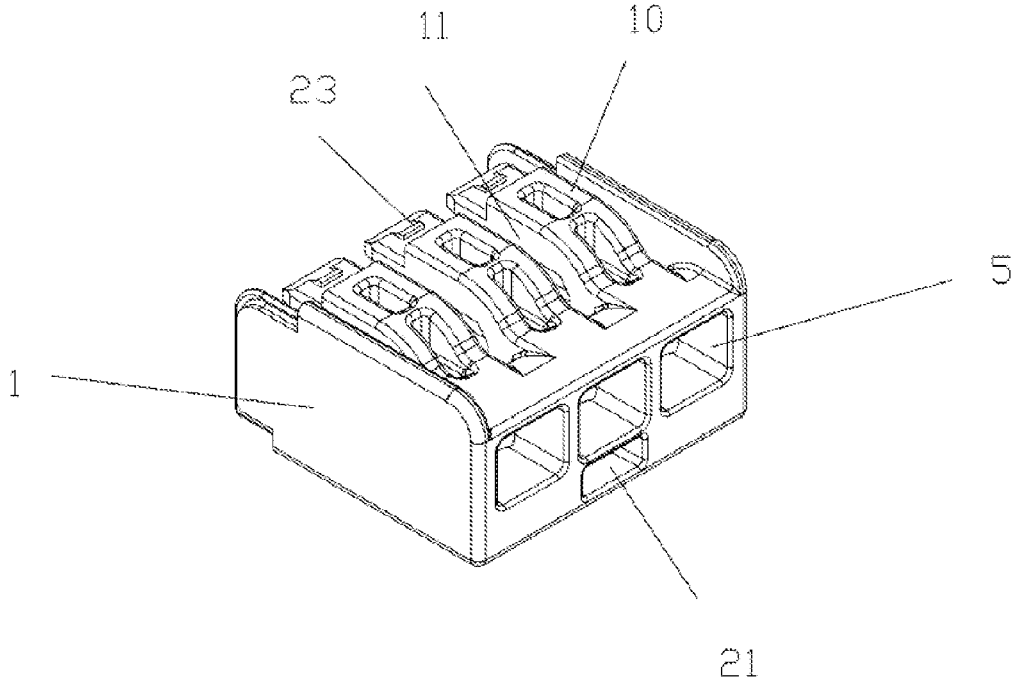
FIG. 4 is another schematic structural view of the front shell, shown from another angle of view.
Figure 5:
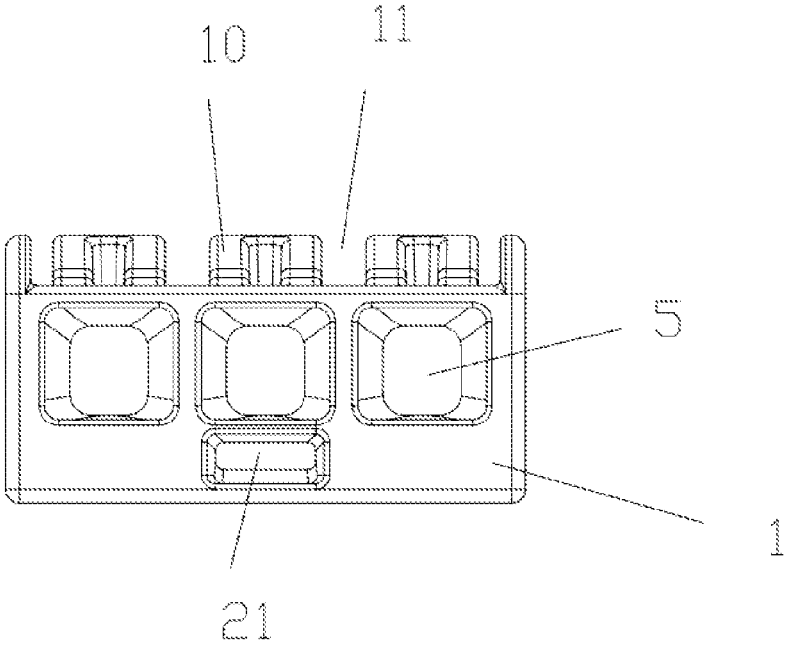
FIG. 5 is a front elevational view of the front shell.
Figure 6:
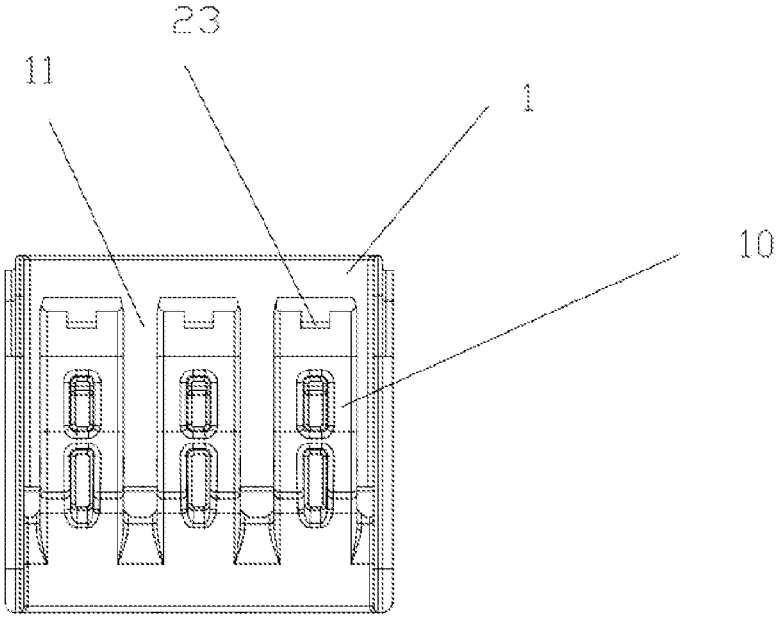
FIG. 6 is a top plan view of the front shell.
Figure 7:
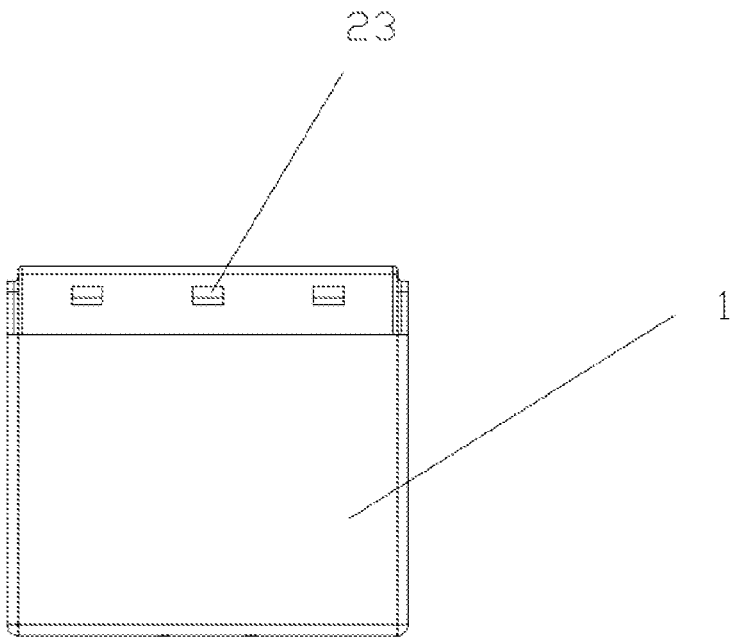
FIG. 7 is a bottom plan view of the front shell.
Figure 8:
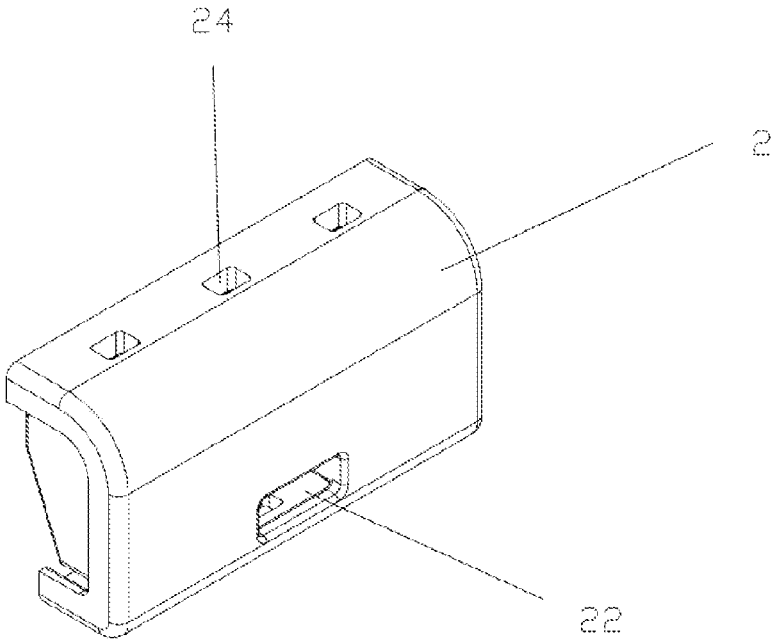
FIG. 8 is a schematic structural view of the rear shell.
Figure 9:
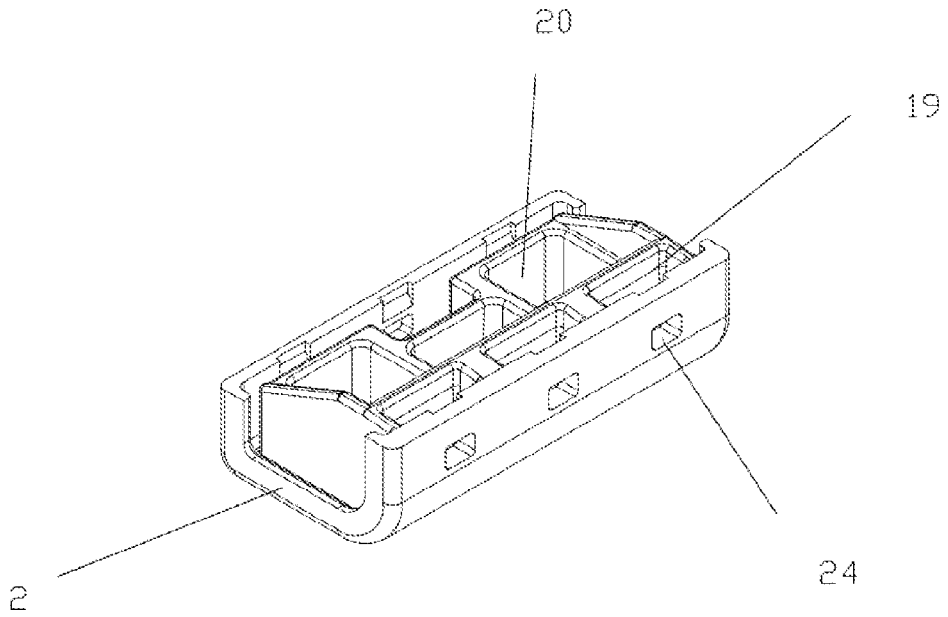
FIG. 9 is another schematic structural view of the rear shell, shown from another angle of view.
Figure 10:
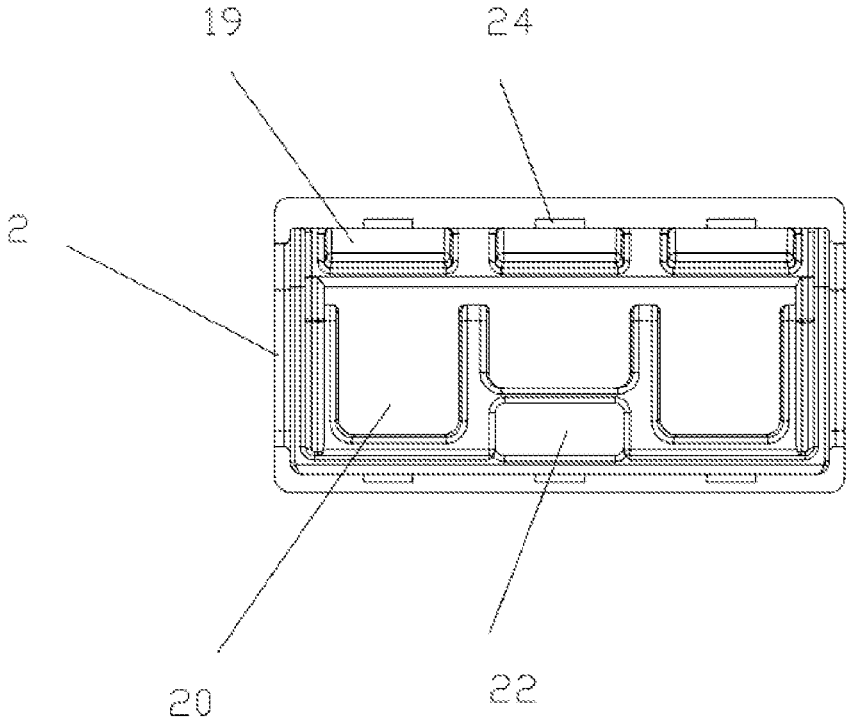
FIG. 10 is a front elevational view of the rear shell.
Figure 11:
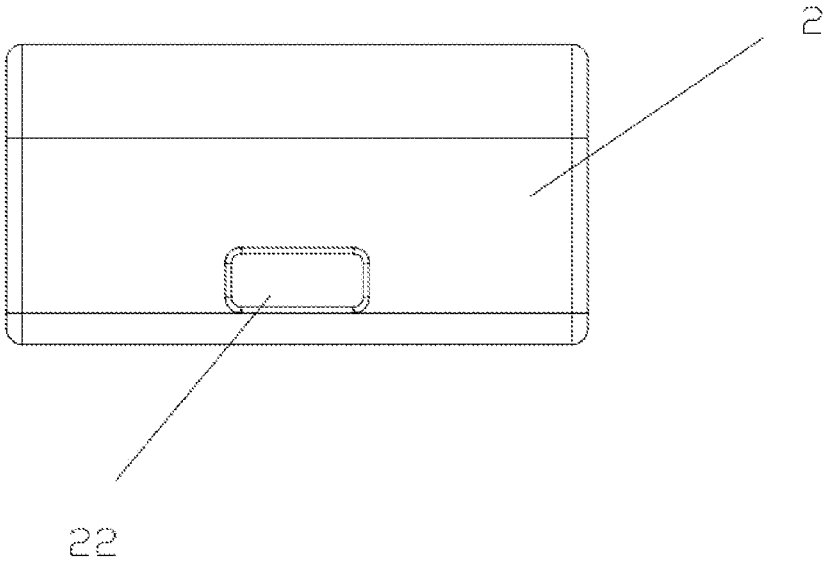
FIG. 11 is a rear elevational view of the rear shell.
Figure 12:
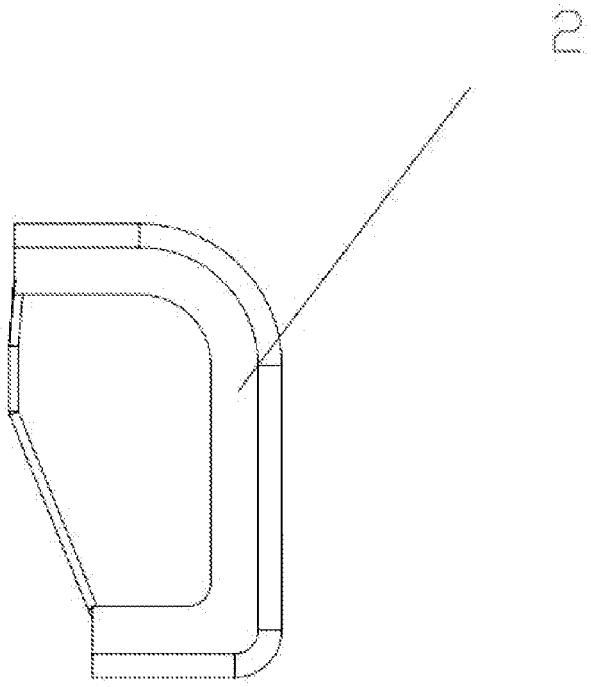
FIG. 12 is a right side view of the rear shell.
Figure 13:
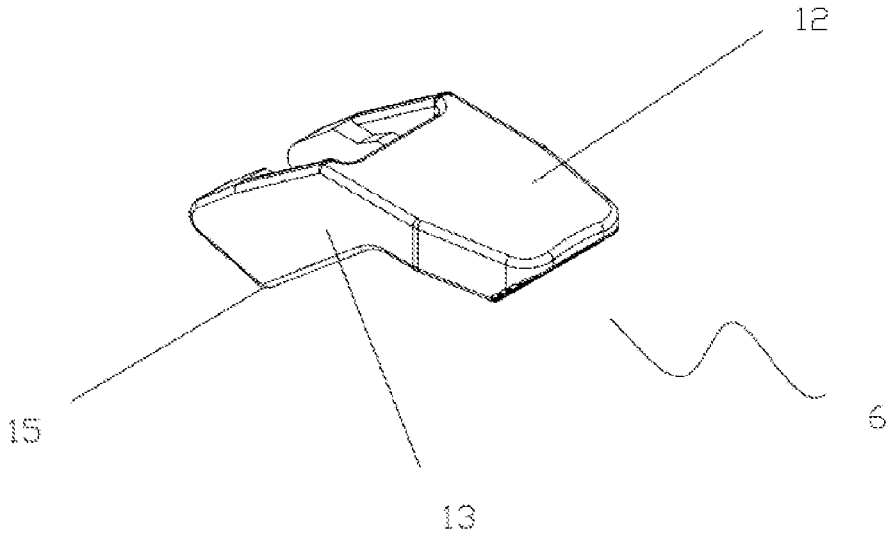
FIG. 13 is a schematic structural view of a pullable cap.
Figure 14:
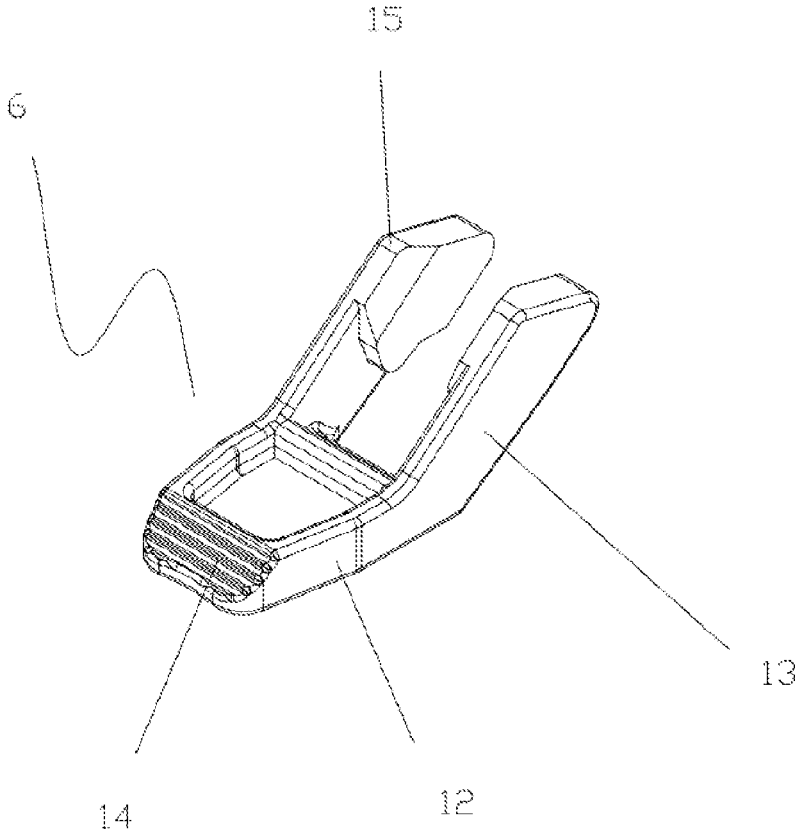
FIG. 14 is another schematic structural view of the pullable cap, shown in another angle of view.
Figure 15:
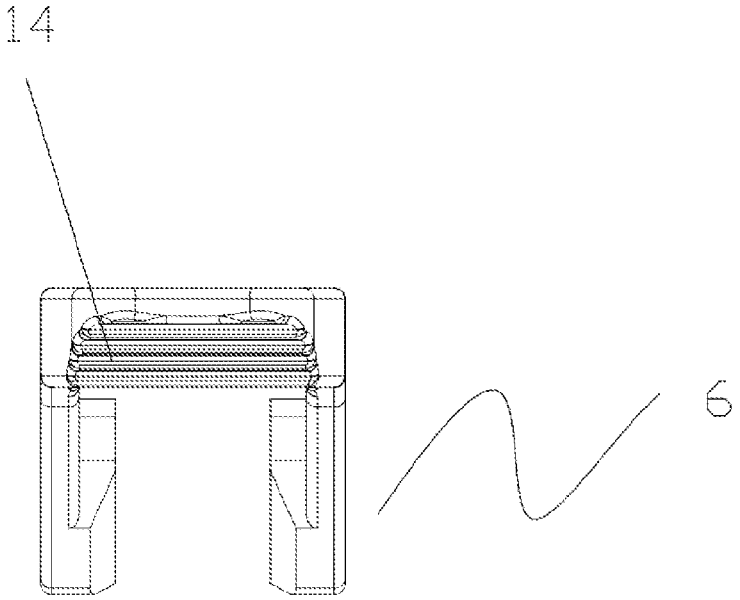
FIG. 15 is a front elevational view of the pullable cap.
Figure 16:
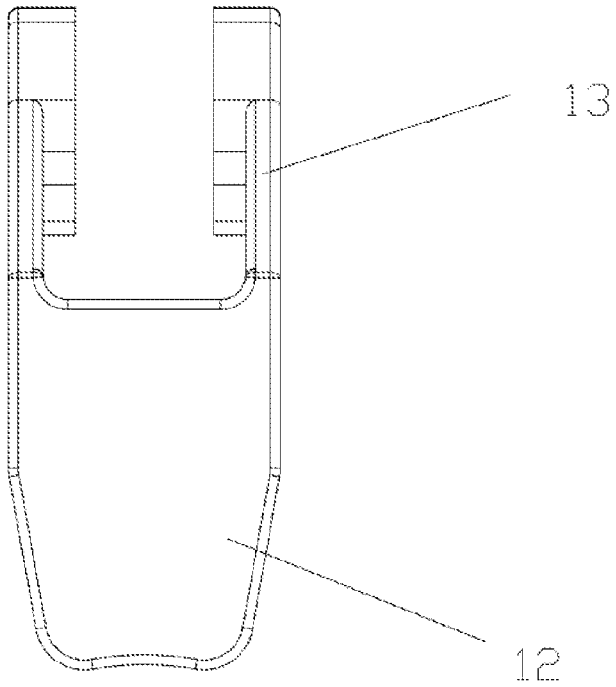
FIG. 16 is a top plan view of the pullable cap.
Figure 17:
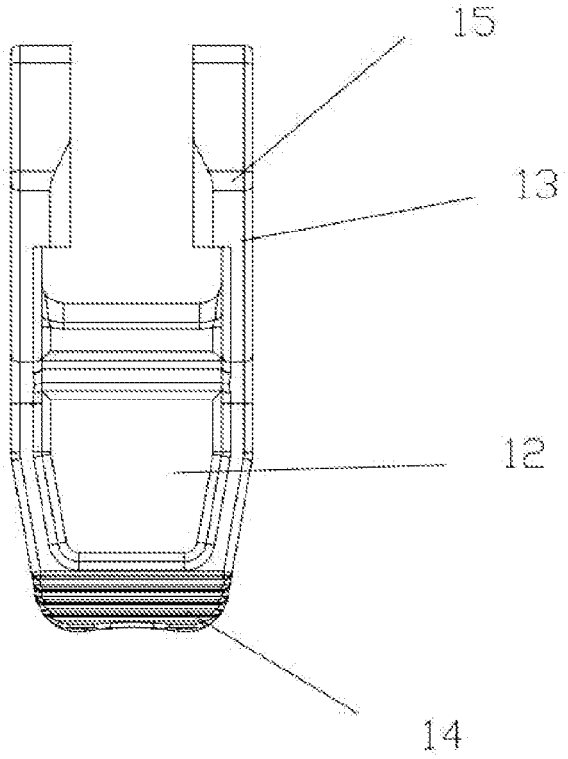
FIG. 17 is a bottom plan view of the pullable cap.
Figure 18:
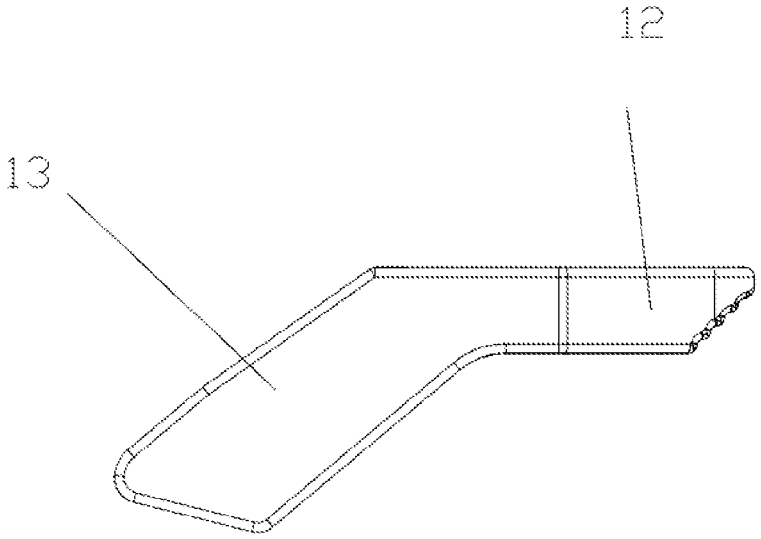
FIG. 18 is a left side view of the pullable cap.
Figure 19:
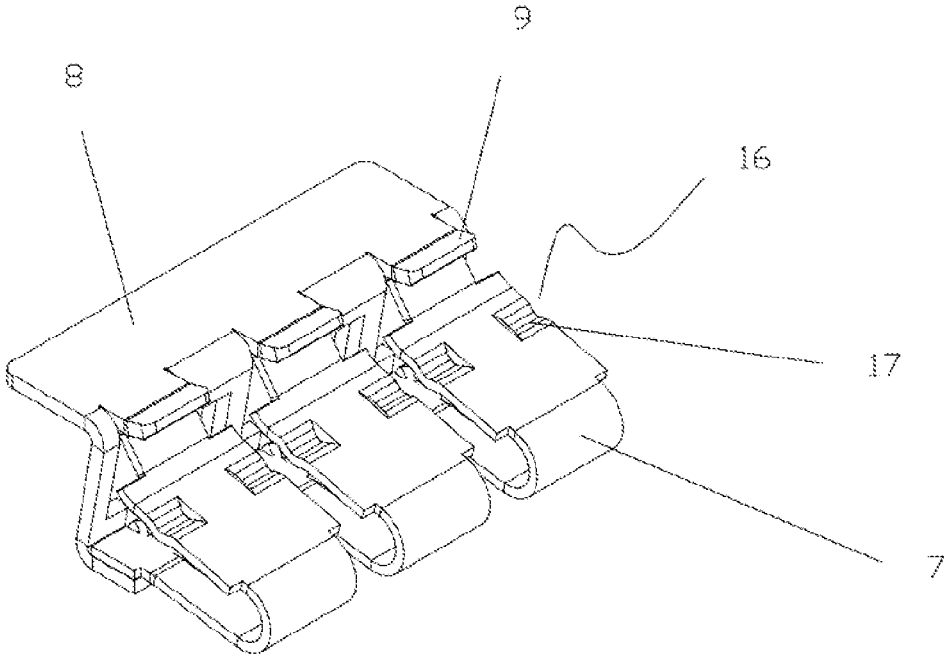
FIG. 19 is a schematic structural view of the metal contact assembly.
Figure 20:
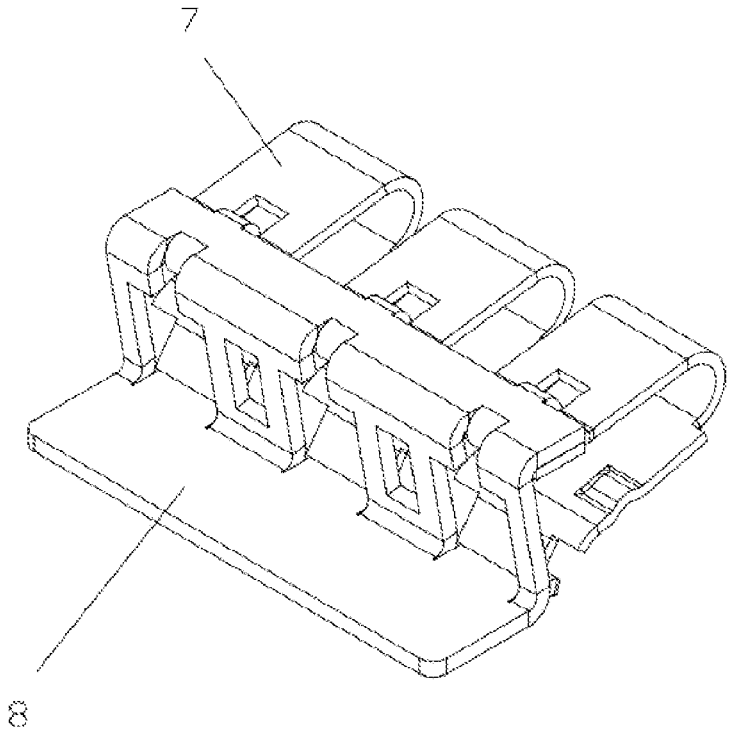
FIG. 20 is another schematic structural view of the metal contact assembly, shown in another angle of view.
Figure 21:
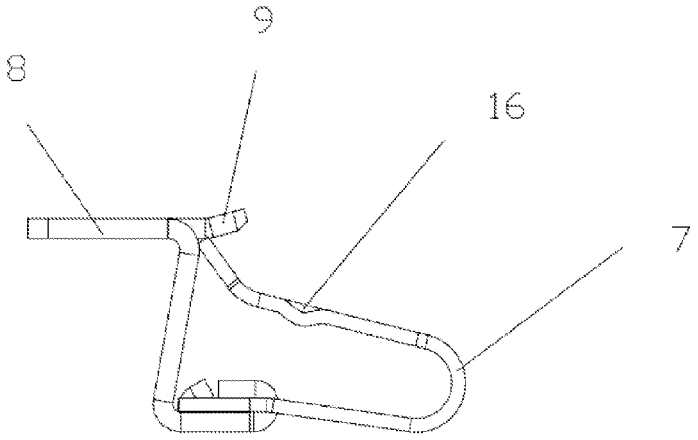
FIG. 21 is a right side view of the metal contact assembly.
Figure 22:
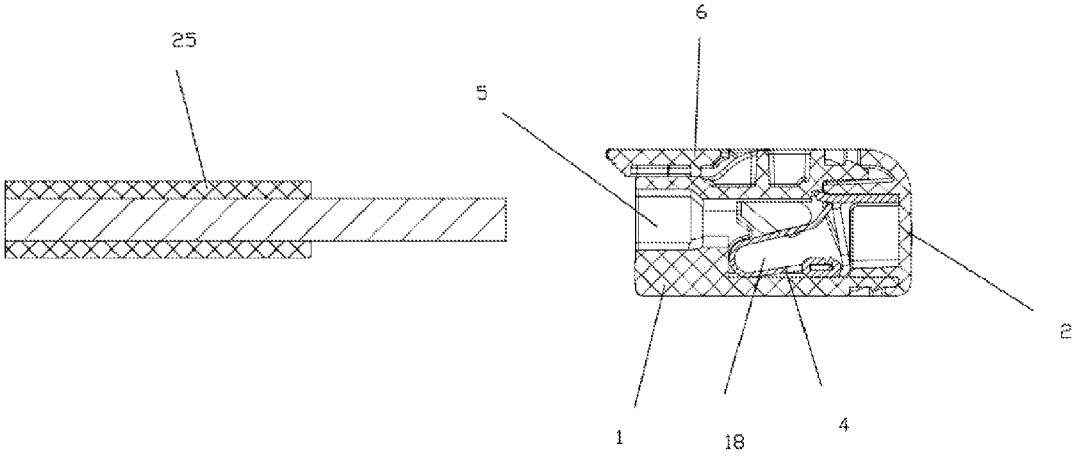
FIG. 22 is a sectional view showing a condition where the wires are not yet connected to the terminal block connector.
Figure 23:
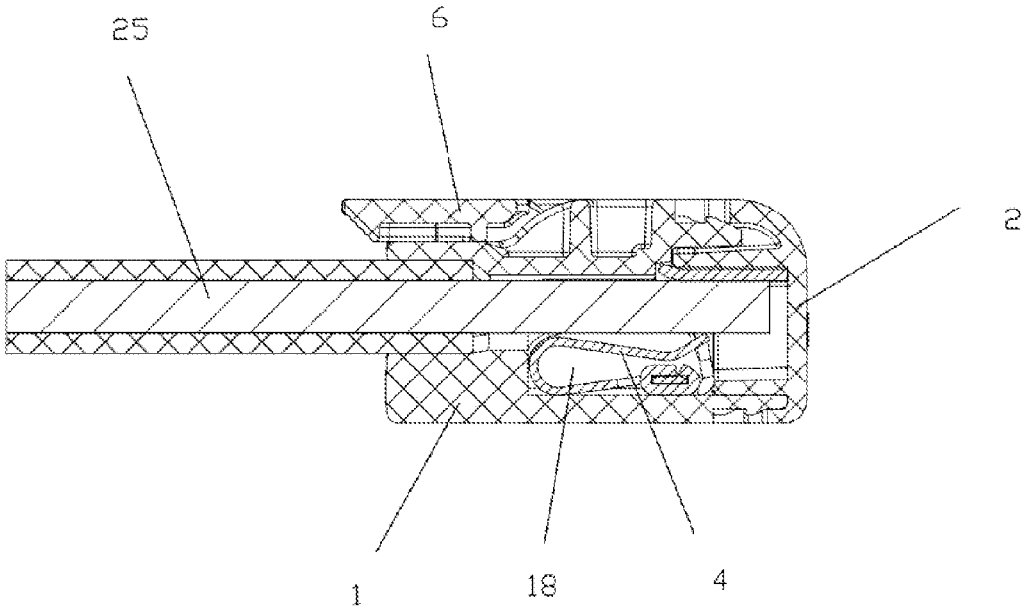
FIG. 23 is a sectional view showing a condition where the wires are connected to the terminal block connector.
Figure 24:
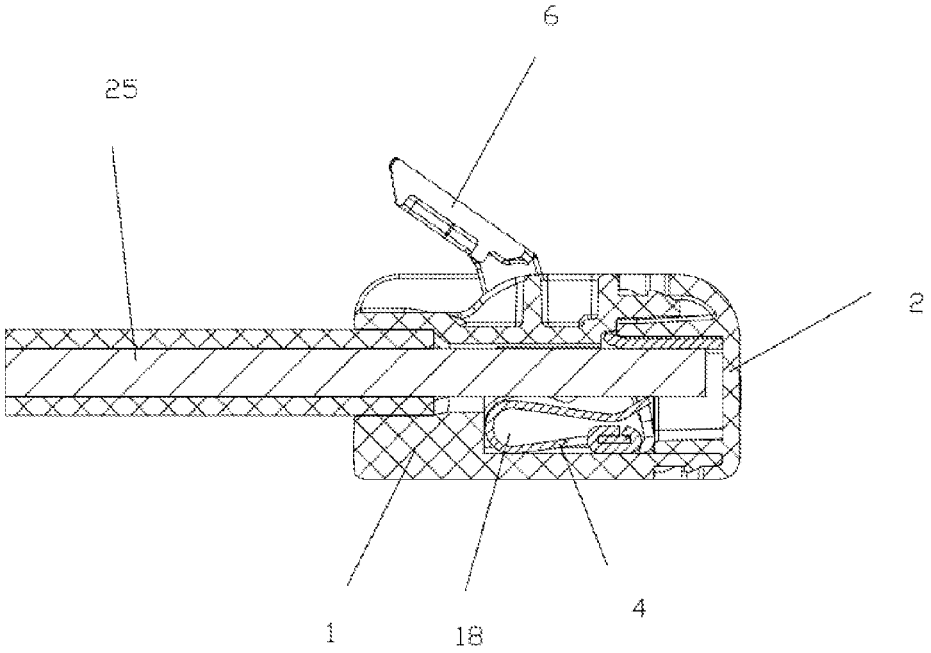
FIG. 24 is a sectional view showing a condition during disconnection between the wires and the terminal block connector.

A terminal block connector according to embodiment 1 of the present invention, illustrated in FIGS. 1-24, comprises an insulated shell 3 formed by a front shell 1 and a rear shell 2. The insulated shell 3 has a cavity inside formed by the front shell 1 and the rear shell 2. A metal contact assembly 4 is provided in the cavity of the insulated shell 3. A front end of the front shell 1 is provided with wire insertion openings 5 corresponding to the metal contact assembly 4. Pullable caps 6 are also provided at a top portion of the insulated shell 3. The metal contact assembly 4 is an integral structure formed by front flexible metal strips 7 corresponding to the wire insertion openings 5 and rear metal strips corresponding to the rear shell 2. Each of the front flexible metal strips 7 has a C-shape whereas a top portion of the C-shape is tilted upwardly. Each of the rear metal strips 8 has a reverse Z-shape. Bottom parts of the rear metal strips 8 are fixedly connected to bottom parts of the front flexible metal strips 7. Top parts of the rear metal strips 8 have protrusions of protruding strips 9. A free end of the upwardly tilted top portion of each of the front flexible metal strips 7 is positioned below each of the protruding strips 9 respectively and tightly contacts with a bottom portion of each of the protruding strips 9 respectively. A top portion of the front shell is provided with bulges 10. A trough 11 is provided at each of the two sides of each of the bulges 10. One end of each of the pullable caps 6 is provided with a pulling grip 12, while another end of each of the pullable caps 6 is provided with two symmetrical press strips 13 which are branched from two sides of the pulling grip 12. The pulling grip 12 is mounted at a top part of a front portion of the front shell 1 and extends out of the front portion of the front shell 1. A front end of the pulling grip 12 is provided with anti-slippery grooves 14. The two symmetrical press strips 13 are inserted into corresponding troughs 11. A bottom part of each of the press strips 13 is provided with a press tip 15 which protrudes to form an acute angle. Each of two sides of the top portion of each of the front flexible metal strips 7 is provided with a recess 16 corresponding to a corresponding press tip 15. Each recess 16 has anti-slippery grooves 17 in a terrace-shape provided on its surface. When the pulling grip 12 of the pulling cap 6 is pulled upwardly, the corresponding press tips 15 will move downwardly and press tightly against the corresponding recesses 16 on the corresponding front flexible metal strip 7. Frictional force is created between the anti-slippery grooves 17 on the surfaces of the corresponding recesses 16 and the press tips 15 so that the press tips 15 press tightly against the recesses 16 and will not displace. Hence, the free end of the upwardly tilted top portion of the corresponding front flexible metal strip 7 and the corresponding protruding strip 9 will not contact each other and a space therebetween will increase. A wire 25 is inserted into the space between the free end of the upwardly tilted top portion of the corresponding front flexible metal strip 7 and the corresponding protruding strip 9 through the corresponding wire insertion opening 5. When the pullable cap 6 is pressed downwardly, the press tips 15 will no longer press tightly against the front flexible metal strip 7, and the front flexible metal strip 7 will then reset to its original position due to its resilience to fix the wire 25 tightly between the free end of the upwardly tilted top portion of the corresponding front flexible metal strip 7 and the corresponding protruding strip 9, thereby achieving wire connection. During installation, the entire metal contact assembly 4 is disposed inside the front shell; since the front shell 1 has a relatively large cavity, such cavity can fix the metal contact assembly 4 in position; after that, fix the front shell 1 with the rear shell 2; finally, insert the press strips 13 of the pullable caps 6 into two sides of the bulges 10 formed on the front shell 1 so that the press tips 15 contact the recesses 16 on the top portion of the front flexible metal strips 7. An entire terminal block connector is then installed.

An inner bottom part of the cavity formed by the front shell 1 and the rear shell 2 is provided with a limiting trough 18 to limit the bottom part of the metal contact assembly 4 so that the metal contact assembly 4 will not displace. Second limiting troughs 19 are provided inside the rear shell 2 for insertion and limiting of the top portions of the rear metal strips 8. The rear shell 2 is also provided with accommodation spaces 20 each being employed for accommodating a part of the wire 25 that has passed through the space between the free end of the upwardly tilted top portion of the corresponding front flexible metal strip 7 and the corresponding protruding strip 9.

A front testing opening 21 communicating with the cavity is provided at the front shell 1 for testing whether the metal contact assembly 4 is being electrically connected. A rear testing opening 22 communicating with the cavity is provided at the rear shell 2 for testing whether the metal contact assembly 4 is being electrically connected.

Hooks 23 are provided at free ends of the top portion of the bulges 10 and also at the bottom portion of the front shell 1. Locking openings 24 corresponding to the hooks 23 are provided at the top and bottom portions of the rear shell 2. The hooks 23 lock at the locking openings 24 in order to fixedly connect the front shell 1 and the rear shell 2.

There can be three wire insertion openings 5. Correspondingly, there can be three front flexible metal strips 7 and three rear metal strips 8 forming the metal contact assembly as an integral structure. Correspondingly, there can be three pullable caps 6, three bulges 10 and three accommodation spaces 20.

The above description is intended to describe only a preferred embodiment of the present invention. It does not limit the technical contents of the present invention. Any simple alteration, changes and modification made in accordance with the essence of the present invention in order to achieve equivalent technical effect should fall within the scope of protection of the present invention.

What is claimed is:

1. A terminal block connector, comprising an insulated shell formed by a front shell and a rear shell; the insulated shell has a cavity inside formed by the front shell and the rear shell; a metal contact assembly is provided in the cavity of the insulated shell; a front end of the front shell is provided with wire insertion openings corresponding to the metal contact assembly; pullable caps are also provided at a top portion of the insulated shell; the terminal block connector is characterized in that, the metal contact assembly is an integral structure formed by front flexible metal strips corresponding to the wire insertion openings and rear metal strips corresponding to the rear shell; each of the front flexible metal strips has a C-shape whereas a top portion of each C-shaped front flexible metal strip is tilted upwardly; each of the rear metal strips has a reverse Z-shape; bottom portions of the rear metal strips are fixedly connected to bottom portions of the front flexible metal strips; top portions of the rear metal strips have protrusions of protruding strips; a free end of the upwardly tilted top portion of each of the front flexible metal strips is positioned below each of the protruding strips respectively and tightly contacts with a bottom portion of each of the protruding strips respectively; a top portion of the front shell is provided with bulges; a trough is provided at each of the two sides of each of the bulges; one end of each of the pullable caps is provided with a pulling grip, while another end of each of the pullable caps is provided with two symmetrical press strips which are branched from two sides of the pulling grip; the pulling grip is mounted at a top part of a front portion of the front shell and extends out of the front portion of the front shell; a front end of the pulling grip is provided with anti-slippery grooves; the two symmetrical press strips are inserted into corresponding troughs; a bottom portion of each of the press strips is provided with a press tip which protrudes to form an acute angle; each of two sides of the top portion of each of the front flexible metal strips is provided with a recess corresponding to a corresponding press tip; each recess has anti-slippery grooves in a terrace-shape provided on a surface thereof; when the pulling grip of each pullable cap is pulled upwardly, corresponding press tips move downwardly and press tightly against corresponding recesses on a corresponding front flexible metal strip; frictional force is created between the anti-slippery grooves on corresponding surfaces of the corresponding recesses and the corresponding press tips so that the corresponding press tips press tightly against the corresponding recesses and do not displace, hence, the free end of the upwardly tilted top portion of the corresponding front flexible metal strip and a corresponding protruding strip is not in contact anymore and a space therebetween increases; a wire is inserted into the space between the free end of the upwardly tilted top portion of the corresponding front flexible metal strip and the corresponding protruding strip through a corresponding wire insertion opening; when the pullable cap is pressed downwardly to return to an original position, the corresponding press tips no longer press tightly against the corresponding front flexible metal strip, and the corresponding front flexible metal strip then resets to an original position thereof due to resilience to fix the wire tightly between the free end of the upwardly tilted top portion of the corresponding front flexible metal strip and the corresponding protruding strip, thereby achieving wire connection.

2. The terminal block connector according to claim 1, wherein an inner bottom part of the cavity formed by the front shell and the rear shell is provided with a limiting trough to limit a bottom portion of the metal contact assembly so that the metal contact assembly does not displace; second limiting troughs are provided inside the rear shell for insertion and limiting of the top portions of the rear metal strips; the rear shell is also provided with accommodation spaces each being employed for accommodating a part of the wire that has passed through the space between the free end of the upwardly tilted top portion of the corresponding front flexible metal strip and the corresponding protruding strip.

3. The terminal block connector according to claim 2, wherein a front testing opening communicating with the cavity is provided at the front shell for testing whether the metal contact assembly is being electrically connected; a rear testing opening communicating with the cavity is provided at the rear shell for testing whether the metal contact assembly is being electrically connected.

4. The terminal block connector according to claim 3, wherein hooks are provided at free ends of the top portions of the bulges and also at a bottom portion of the front shell; locking openings corresponding to the hooks are provided at both a top portion and a bottom portion of the rear shell; the hooks lock at the locking openings in order to fixedly connect the front shell and the rear shell.

5. The terminal block connector according to claim 4, wherein a quantity of the wire insertion openings is three; correspondingly, the metal contact assembly is provided with three front flexible metal strips and three rear metal strips forming the metal contact assembly as an integral structure; correspondingly, a quantity of the pullable caps is also three, a quantity of the bulges is also three, and a quantity of the accommodation spaces is also three.

* * * * *